US007083476B2

(12) United States Patent
Helbig et al.

(10) Patent No.: US 7,083,476 B2
(45) Date of Patent: Aug. 1, 2006

(54) BASE FOR A HEADLIGHT LAMP AND HEADLIGHT LAMP

(75) Inventors: Peter Helbig, Sontheim (DE); Uwe Kantim, Heidenheim (DE)

(73) Assignee: Patent-Treuhand-Gesellschaft für elektrische Glühlampen mbH, Munich (DE)

( * ) Notice: Subject to any disclaimer, the term of this patent is extended or adjusted under 35 U.S.C. 154(b) by 49 days.

(21) Appl. No.: 11/056,127

(22) Filed: Feb. 14, 2005

(65) Prior Publication Data

US 2005/0181678 A1 Aug. 18, 2005

(30) Foreign Application Priority Data

Feb. 12, 2004 (DE) ..... 10 2004 007 150

(51) Int. Cl.
*H01R 24/00* (2006.01)

(52) U.S. Cl. ..... 439/694.2; 439/619

(58) Field of Classification Search ..... 439/699.1, 439/699.2, 619, 336; 313/318.01, 318.05, 313/318.12

See application file for complete search history.

(56) References Cited

U.S. PATENT DOCUMENTS 3,999,095 A * 12/1976 Pearce et al. ..... 313/318.1
4,573,754 A * 3/1986 Hill ..... 439/280
4,630,877 A * 12/1986 Moore ..... 439/282
4,653,841 A * 3/1987 Plyler et al. ..... 439/660
4,687,965 A * 8/1987 Sanders et al. ..... 313/318.05
4,751,421 A * 6/1988 Braun et al. ..... 313/318.11
4,752,241 A * 6/1988 Matsuoka et al. ..... 439/619
4,871,331 A * 10/1989 Kondo et al. ..... 439/736
4,958,429 A * 9/1990 Forish et al. ..... 29/877
5,000,702 A * 3/1991 Forish et al. ..... 439/699.2
5,035,643 A * 7/1991 Forish et al. ..... 439/358
5,036,439 A * 7/1991 Hoffmann et al. ..... 362/459
5,080,615 A * 1/1992 Kondo ..... 439/699.2
5,121,304 A * 6/1992 Hall et al. ..... 362/548
5,154,645 A * 10/1992 Harada et al. ..... 439/736
5,238,429 A * 8/1993 Margrave et al. ..... 439/620
5,479,066 A * 12/1995 Willems et al. ..... 313/318.05
5,501,618 A * 3/1996 Muta et al. ..... 439/699.2
5,507,670 A * 4/1996 Ogawa ..... 439/699.1
5,509,828 A * 4/1996 Muta et al. ..... 439/699.2
5,511,988 A * 4/1996 Ogawa et al. ..... 439/336
5,547,402 A * 8/1996 Ogawa ..... 439/699.2
5,637,020 A * 6/1997 Ito ..... 439/699.2
5,709,450 A * 1/1998 Francis et al. ..... 362/546
5,839,818 A * 11/1998 Janson et al. ..... 362/645
5,846,100 A * 12/1998 Ogawa ..... 439/736
5,876,251 A * 3/1999 Muta ..... 439/699.2

(Continued)

FOREIGN PATENT DOCUMENTS

DE 101 48 114 4/2003

*Primary Examiner*—Ross Gushi
(74) *Attorney, Agent, or Firm*—William E. Meyer

(57) ABSTRACT

A base for a headlight lamp, which has a plastic base part having at least two electrical connections, which have a first end with a contact face, the first ends protruding from the base part when mounted such that the contact faces are perpendicular to the longitudinal extent of the headlight lamp, and a second end to be connected to a power supply wire and extends parallel to the longitudinal extent of the headlight lamp. For each electrical connection, the first and second ends are connected to one another by a central section, and these central sections are embedded in the plastic of the base part and the second ends are bent back from the respective central section.

4 Claims, 3 Drawing Sheets

Figure 1:
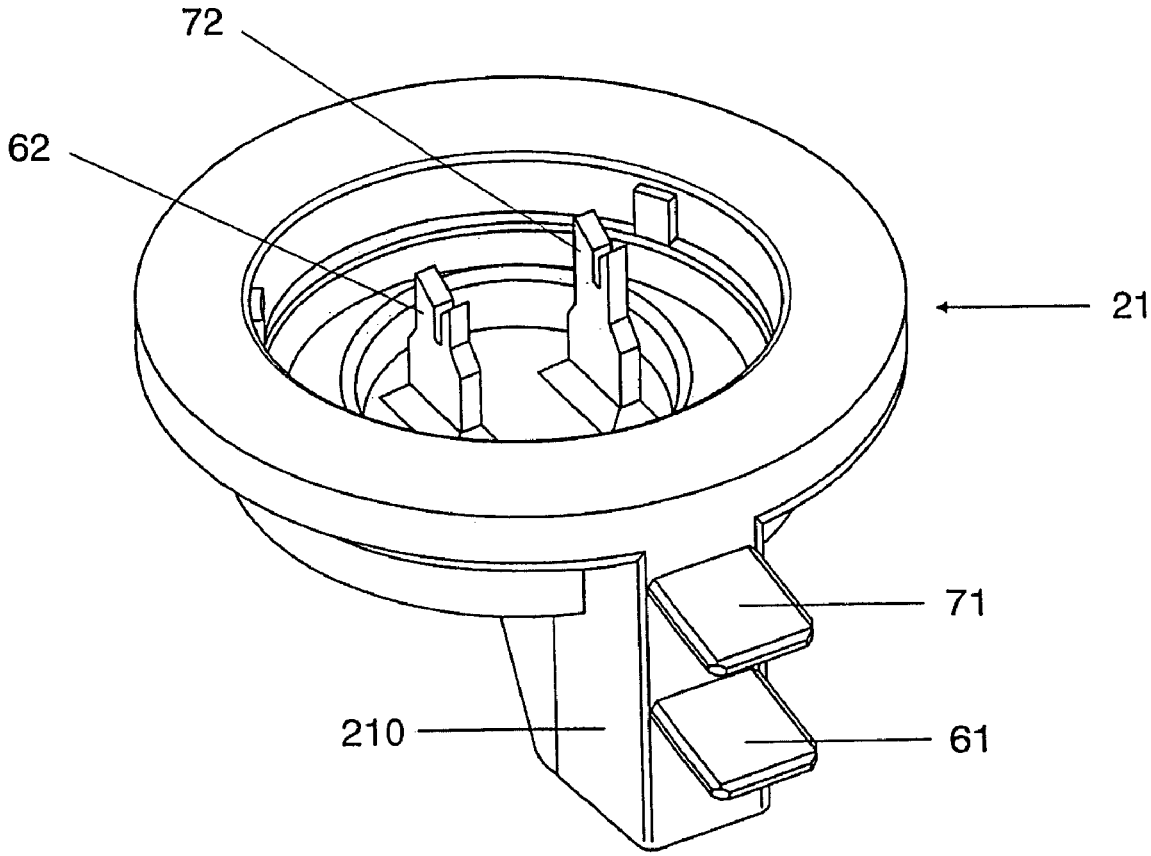

U.S. PATENT DOCUMENTS 5,957,569 A * 9/1999 Helbig et al. ..... 362/263
5,996,424 A * 12/1999 Tan et al. ..... 73/864.34
6,005,336 A * 12/1999 Helbig et al. ..... 313/318.01
6,048,231 A * 4/2000 Yamanashi et al. ..... 439/699.2
6,080,019 A * 6/2000 Coushaine ..... 439/611
6,095,866 A * 8/2000 Helbig et al. ..... 439/619
6,244,737 B1 6/2001 Rittner et al.
6,260,986 B1 * 7/2001 Helbig et al. ..... 362/640
6,270,235 B1 * 8/2001 Coushaine ..... 362/645
6,296,373 B1 * 10/2001 Gal et al. ..... 362/655
6,328,455 B1 * 12/2001 Helbig ..... 362/657
6,536,929 B1 * 3/2003 Forgacs et al. ..... 362/519
6,628,081 B1 * 9/2003 Behr et al. ..... 315/56
6,692,308 B1 * 2/2004 Henrici et al. ..... 439/699.2
6,713,948 B1 * 3/2004 Meinecke ..... 313/318.01
6,884,118 B1 * 4/2005 Street et al. ..... 439/619
6,946,782 B1 * 9/2005 Beying et al. ..... 313/318.02
7,014,510 B1 * 3/2006 Powers et al. ..... 439/699.2
7,025,634 B1 * 4/2006 Swantner et al. ..... 439/619

* cited by examiner

BASE FOR A HEADLIGHT LAMP AND HEADLIGHT LAMP

I. TECHNICAL FIELD

The invention relates to a base for a headlight lamp, which has a plastic base part having at least two electrical connections, which are each made from a metal sheet and have a first end provided with a contact face, the first ends protruding from the base part when mounted such that the contact faces are arranged perpendicular to the longitudinal extent of the headlight lamp, and said at least two electrical connections each having a second end, which is to be connected to a power supply wire and extends parallel to the longitudinal extent of the headlight lamp.

II. BACKGROUND ART

Such a base and such a headlight lamp are disclosed, for example, in the laid-open specification DE 101 48 114 A1. This specification describes a headlight lamp having a metal/plastic base. Three electrical connections, which are in the form of contact lugs and extend in the radial direction perpendicular to the longitudinal axis of the headlight lamp, protrude from the plastic base part of these headlight lamps.

III. DISCLOSURE OF THE INVENTION

The object of the invention is to provide improved electrical connections for a generic base and the corresponding headlight lamp.

This object is achieved according to the invention by a base for a headlight lamp, which has a plastic base part having at least two electrical connections, which are each made from a metal sheet and have a first end provided with a contact face, the first ends protruding from the base part when mounted such that the contact faces are arranged perpendicular to the longitudinal extent of the headlight lamp, and said at least two electrical connections each having a second end, which is to be connected to a power supply wire and extends parallel to the longitudinal extent of the headlight lamp, wherein, for each electrical connection, the first and the second end are in each case connected to one another by a central section, and these central sections of the two electrical connections are embedded in the plastic of the base part such that the surfaces of the central sections are arranged on different planes perpendicular to the longitudinal extent of the headlight lamp, and the second ends being bent back from the respective central section such that the surfaces of the second ends are arranged perpendicular to the surfaces of the respective central section. Particularly advantageous embodiments of the invention are described in the dependent claims.

The base according to the invention for a headlight lamp has a plastic base part having at least two electrical connections, which are each made from a metal sheet and have a first end provided with a contact face, the first ends protruding from the base part when mounted such that the contact faces are arranged perpendicular to the longitudinal extent of the headlight lamp, and which each have a second end, which is to be connected to a power supply wire and extends parallel to the longitudinal extent of the headlight lamp. According to the invention, for each electrical connection, the first and the second end are in each case connected to one another by a central section, and these central sections of the two electrical connections are embedded in the plastic of the base part such that the surfaces of the central sections are arranged on different planes perpendicular to the longitudinal extent of the headlight lamp, the second ends being bent back from the respective central section such that the surfaces of the second ends are arranged perpendicular to the surfaces of the respective central section.

As a result, the electrical connections are, on the one hand, suitable for fixing the headlight lamp, in the manner of a bayonet fitting, in the lampholder of the headlight by rotating it about its longitudinal axis and, at the same time, for making contact with it by means of its first ends, and, on the other hand, the two ends of the electrical connections are aligned such that they can be welded to the power supply wires, which are passed out of the lamp vessel, in the same manner as is described in the laid-open specification DE 198 55 412 A1.

The plastic base part is advantageously in the form of a plastic injection-molded part. As a result, the central sections of the electrical connections can be embedded in the plastic material of this base part by means of injection molding. The second ends of the electrical connections are preferably each provided with a groove in order to make it possible to fix the power supply wires protruding from the lamp vessel in said groove before the welded joint is produced.

IV. BRIEF DESCRIPTION OF THE DRAWINGS

Figure 2:
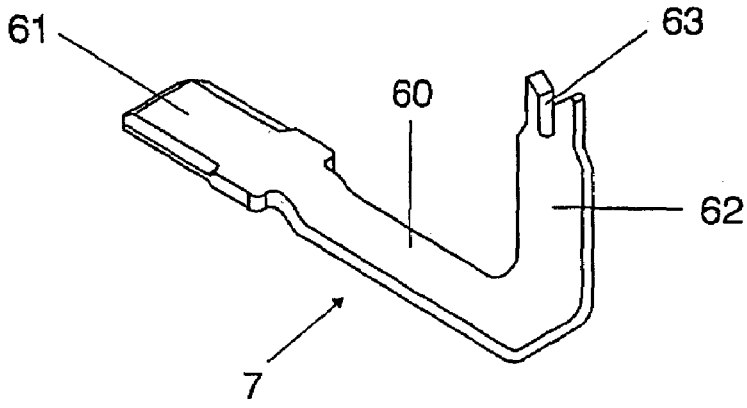
Figure 3:
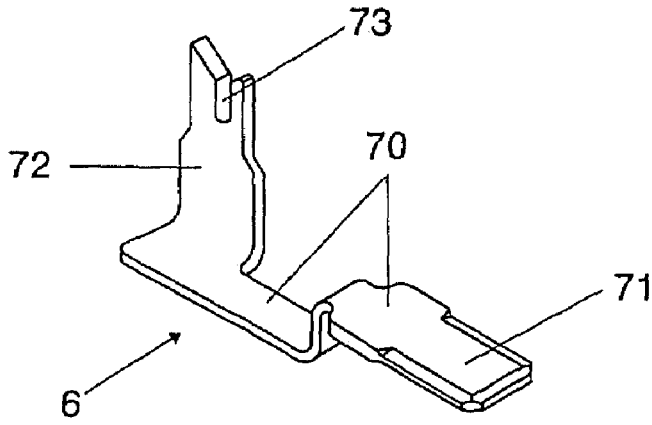
Figure 4:
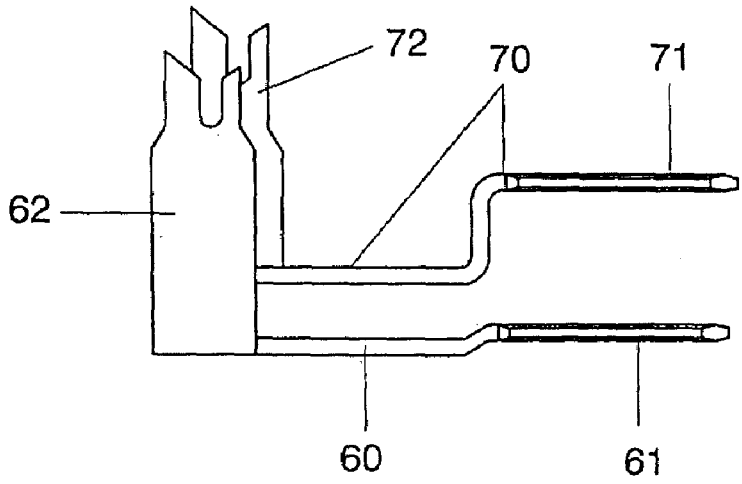
Figure 5:
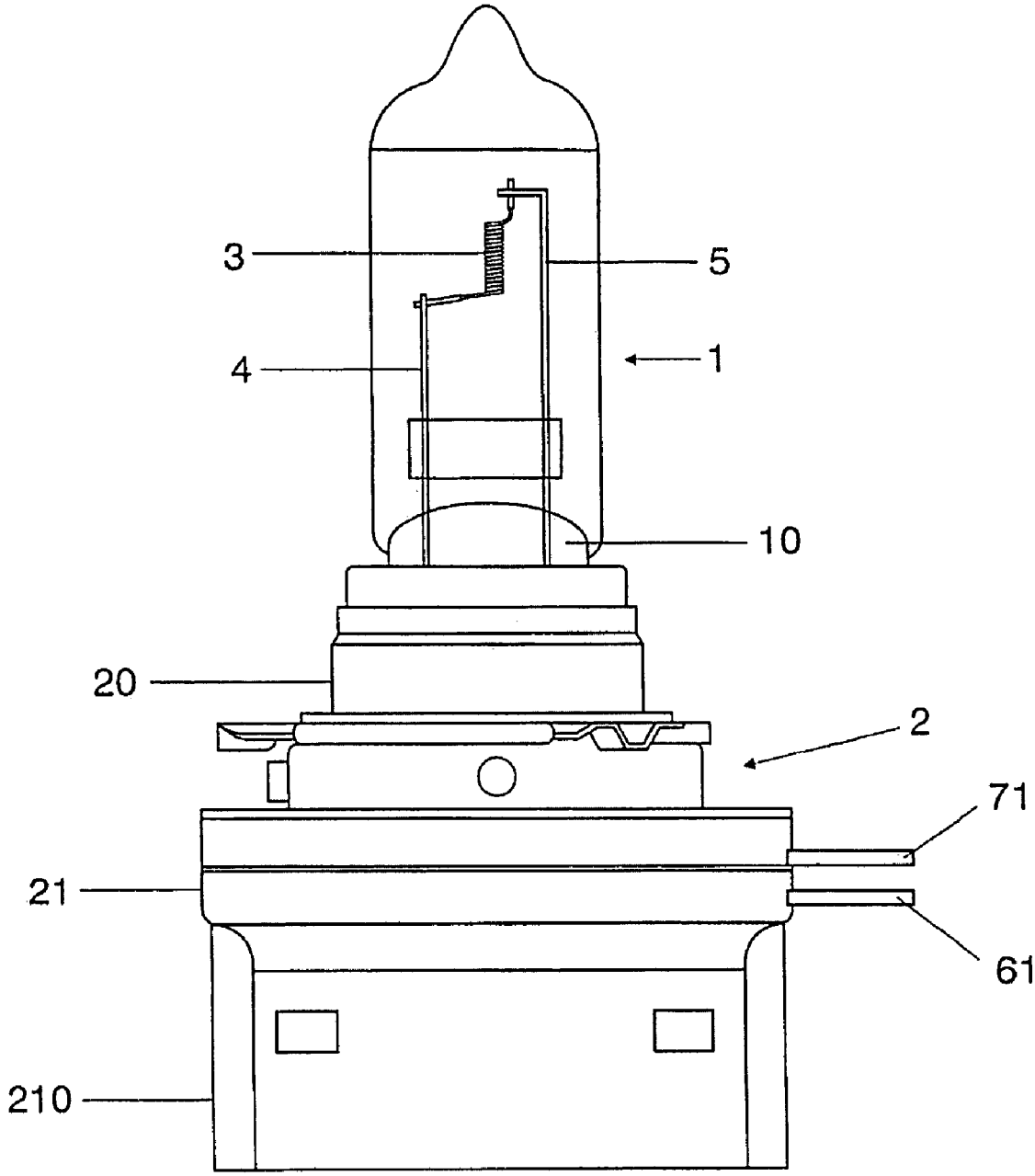

The invention will be explained in more detail below with reference to a preferred exemplary embodiment. In the drawing:

FIG. 1 shows a plan view of the plastic base part of the base according to the preferred exemplary embodiment of the invention, FIG. 2 shows a plan view of the first contact lug of the base part depicted in FIG. 1, FIG. 3 shows a plan view of the second contact lug of the base part depicted in FIG. 1, FIG. 4 shows a side view of the contact lugs depicted in FIGS. 1 to 3 and their relative physical arrangement, and FIG. 5 shows a side view of a headlight lamp according to the preferred exemplary embodiment of the invention.

V. BEST MODE FOR CARRYING OUT THE INVENTION

The preferred exemplary embodiment of the headlight lamp according to the invention which is depicted in FIG. 5 is a halogen incandescent lamp of the H11 lamp type, which can be used in a motor vehicle headlight, for example for the purpose of producing the lower beam, upper beam or fog light. This lamp has a vitreous lamp vessel 1 having a sealed-off end 10, which is anchored in a base 2. An axially aligned incandescent filament 3, whose outgoing filament lines are each connected to a power supply wire 4, 5 passed out of the sealed-off end 10, is arranged in the interior of the lamp vessel 1. The base 2 is a so-called metal/plastic base. That is to say that it has both metallic and plastic base parts. The sealed-off end 10 of the lamp vessel 1 is anchored in the metallic base part 20. The metallic base part 20 is in turn fixed in the plastic base part 21, which is provided with two electrical connections 6, 7. The electrical connections 6, 7 are each made from a metal sheet and each have a first end 61, 71, which is provided with a contact face and which protrudes in the radial direction from the plastic base part 21 such that the contact faces of these ends 61, 71 are arranged on different planes perpendicular to the longitudinal axis of the headlight lamp at a small spacing one above the other or one next to the other.

FIGS. 1 to 4 show details of the plastic base part 21 and the electrical connections 6, 7, in the form of contact lugs, of the headlight lamp. The base part 21 depicted in FIG. 1 is made of a thermoplastic and is in the form of a plastic injection-molded part. The electrical connections 6, 7 are embedded in the material of the base part 21 by means of plastic injection molding. The plastic base part 21 is in the form of a pot and is equipped on the base, i.e. on the side remote from the lamp vessel 1, with a grip part 210. The first ends 61, 71 of the electrical connections 6, 7 protrude from the plastic base part 21.

The two electrical connections 6, 7 are each made from a metal sheet and are in the form of integral contact lugs of differing design. The first contact lug 6, which is arranged closer to the grip part 210, has a first end 61, which is equipped with a flat contact face which is aligned perpendicular to the longitudinal axis of the lamp. The first end 61 protrudes from the base part 21. It is connected to the second end 62 by means of the central section 60. The surfaces, i.e. the two sides of the central section 60, have the same orientation as the flat contact faces or surfaces of the first end 61. That is to say, the surfaces of the central section 60 are arranged perpendicular to the longitudinal axis of the lamp when mounted in the base part 21. The second end 62 is bent back from the central section 60 such that the surfaces, i.e. the two sides, of the second end 62 are arranged perpendicular to the surfaces of the central section 60. Once the contact lug 6 has been mounted in the base part 21, the second end 62 is aligned parallel to the longitudinal axis of the headlight lamp. The second end 62 is equipped with a groove 63, in which a bent-back end of the power supply wire 5 is fixed by means of welding.

The second contact lug 7 has a first end 71, which is equipped with a flat contact face which is aligned perpendicular to the longitudinal axis of the lamp. The first end 71 protrudes from the base part 21. It is connected to the second end 72 by means of the stepped central section 70. The surfaces, i.e. the two sides, of the central section 70 have the same orientation as the flat contact faces or surfaces of the first end 71. That is to say, the two sides, in this case the upper side and the lower side, of the central section 70 are arranged perpendicular to the longitudinal axis of the lamp once mounted in the base part 21. The second end 72 is bent back from the central section 70 such that the surfaces, i.e. the two sides, of the second end 72 are arranged perpendicular to the two sides of the central section 70. Once the contact lug 7 has been mounted in the base part 21, the second end 72 is aligned parallel to the longitudinal axis of the headlight lamp. The second end 72 is equipped with a groove 73, in which a bent-back end of the power supply wire 4 is fixed by means of welding.

FIG. 4 shows a schematic illustration of the relative physical arrangement of the two contact lugs 6, 7. The individual sections of the two contact lugs 6, 7, i.e. the two sides of their first ends 61, 71 and their central sections 60, 70 as well as their second ends 62, 72, are each aligned parallel to one another. The central sections 60, 70 are embedded in the plastic base part 21 by means of injection molding.

What is claimed is:

1. A base for a headlight lamp, which has a plastic base part having at least two electrical connections, which are each made from a metal sheet and have a first end provided with a contact face, the first ends protruding from the base part when mounted such that the contact faces are arranged perpendicular to the longitudinal extent of the headlight lamp, and the at least two electrical connections each having a second end, which is to be connected to a power supply wire and extends parallel to the longitudinal extent of the headlight lamp, wherein, for each electrical connection, the first and the second end are in each case connected to one another by a central section, and these central sections of the two electrical connections are embedded in the plastic of the base part such that the surfaces of the central sections are arranged on different planes perpendicular to the longitudinal extent of the headlight lamp, and the second ends being bent back from the respective central section such that the surfaces of the second ends are arranged perpendicular to the surfaces of the respective central section.

2. The base as claimed in claim 1, wherein the plastic base part is a plastic injection-molded part.

3. The base as claimed in claim 1, wherein the two ends are each equipped with a groove.

4. A headlight lamp having a base as claimed in claim 1.

* * * * *